United States Patent [19]

Stonesifer et al.

[11] Patent Number: 4,706,853

[45] Date of Patent: Nov. 17, 1987

[54] CAULKING GUN WITH MEANS TO PREVENT ROTATION OF COMPOUND CARTRIDGE DURING USE AND TO PROVIDE POSITIVE PRESSURE RELEASE

[76] Inventors: Gerald M. Stonesifer, 217 W. Eighth St., Charlotte, N.C. 28202; Charles E. Harkey, 8715 Reedy Creek Rd., Charlotte, N.C. 28215

[21] Appl. No.: 817,982

[22] Filed: Jan. 13, 1986

[51] Int. Cl.[4] ..... B67D 5/42

[52] U.S. Cl. ..... 222/391; 222/327

[58] Field of Search ..... 222/327, 391, 386, 390; 401/177, 179; 604/224, 228

[56] References Cited

U.S. PATENT DOCUMENTS

| | | | |
|---|---|---|---|
| 1,637,955 | 8/1927 | McLaughlin | 222/391 |
| 2,768,768 | 10/1956 | Cornell et al. | 222/327 |
| 2,946,331 | 7/1980 | Jungst et al. | 604/228 |
| 3,259,130 | 7/1966 | Krauthamer | 604/228 |

FOREIGN PATENT DOCUMENTS

| | | | |
|---|---|---|---|
| 1204113 | 10/1965 | Fed. Rep. of Germany | 222/391 |
| 776968 | 2/1935 | France | 604/228 |
| 2076473 | 12/1981 | United Kingdom | 222/391 |

*Primary Examiner*—H. Grant Skaggs

*Attorney, Agent, or Firm*—W. Thad Adams, III

[57] ABSTRACT

A caulking gun adapted to receive a tube-like cartridge of compound, wherein the cartridge has a piston in one end which expels compound from a dispensing nozzle as the piston is moved forward in the cartridge towards the dispensing nozzle. The gun includes a cartridge holder, a handle attached to the cartridge holder, and a trigger cooperating with the handle to urge a stem fixed against rotational movement relative to said cartridge holder and a disk fixed on the stem against rotational movement relative to the stem against the piston of the cartridge to expel compound from the discharge nozzle. One outwardly projecting prong is eccentrically positioned on the disk in contact relation with the piston of the cartridge for wedging into the contact surface of the piston without puncturing through the piston into the cartridge, whereby compound is prevented from leaking. The prong engages the piston to prevent rotation of the cartridge as compound is expelled in order to maintain the angle of articulation and to exert a positive pull on the piston and urge it rearwardly away from the dispensing nozzle as the stem is retracted from contact with the piston and before disengaging completely from the piston. This releases pressure on the piston and stops the flow of compound from the dispensing nozzle.

5 Claims, 4 Drawing Figures

CAULKING GUN WITH MEANS TO PREVENT ROTATION OF COMPOUND CARTRIDGE DURING USE AND TO PROVIDE POSITIVE PRESSURE RELEASE

TECHNICAL FIELD AND BACKGROUND OF THE INVENTION

This invention relates to caulking guns of the type wherein a compound such as caulk for adhesive is expelled from a tube-like disposable cartridge of compound carried by the gun.

There are two basic types of caulking guns to which this invention applies. The first type, exemplified by the disclosure in the Weiss U.S. Pat. No. 4,509,662 includes a substantially hemispherical, trough-like cradle which receives the cartridge of compound.

The other type is a "skeleton" type of caulking gun which comprises two vertically spaced-apart metal members which are secured to a round end plate on one end and a handle structure on the opposite end. The cartridge is positioned between the upper and lower members which comprise the skeleton and held in place by the end cap through which the dispensing nozzle of the cartridge projects.

The invention described below has equal application to both types of caulking guns.

Such caulking guns have a variety of uses. One common use is applying an even bead of caulk into a crack between two adjacent structural members in order to prevent the passage of air between them. Another common use is to apply adhesive to building materials such as countertops or wall panels. In both cases, it is a common practice to cut the plastic tip of the dispensing nozzle at a predetermined angle. The dispensing nozzle is then articulated as desired relative to the working surface and the caulk or other compound is expelled. The angled cut provides a ready means of applying the caulk directly into the crack or onto the surface intended while the outwardly projecting top formed by the angle smooths the surface of the caulk. For this procedure to work properly, the angle of the cut must be articulated with the direction of movement of the caulking gun. However, it is well known that the cartridge is prone to rotate within either the cradle or the skeleton which holds the cartridge. This rotation causes the caulk to exit the dispensing nozzle to one side or the other of the intended point of application. When this happens, the caulk must either be removed and applied again after the dispensing nozzle has been correctly positioned or by moving the bead of caulk into its proper position by the finger. In either case, both time and materials are wasted.

Another problem encountered in using prior art caulking guns is the tendency for the release of pressure by the gun on the piston of the cartridge to be incomplete. This causes caulk to continue to ooze from the dispensing nozzle after the gun has been removed from the point of application. The invention described in this application solves both problems.

SUMMARY OF THE INVENTION

Therefore, it is an object of the invention to provide a caulking gun of the type adapted to receive a tube-like cartridge of compound which includes means engaging the piston of the cartridge to prevent rotation of the cartridge as compound is expelled in order to maintain the angle of articulation of an angularly-cut dispensing nozzle.

It is another object of the present invention to provide a caulking gun of the type adapted to receive a tube-like cartridge of compound which includes means for providing a positive pressure release on the piston for stopping the flow of compound from the dispensing nozzle when desired.

These and other objects and advantages of the present invention are achieved in the preferred embodiments disclosed below by providing a caulking gun of the type adapted to receive a tube-like cartridge of compound. The cartridge has a piston in one end which expels compound from a dispensing nozzle in the other end as the piston is moved forward in the cartridge against the compound and towards the dispensing nozzle. The gun also includes a cartridge holder, a handle attached to the cartridge holder and a trigger cooperating with the handle to progressively urge a stem having a disk on its end against the piston of the cartridge to expel compound from the discharge nozzle.

The improvement in connection with the caulking gun comprises a prong positioned on the disk in contact relation with the piston of the cartridge for penetrating the contact surface of the piston, but not puncturing the piston so as to allow compound to leak from the cartridge. The prong engaging the piston prevents rotation of the cartridge as compound is expelled in order to maintain the angle of articulation of an angularly cut dispensing nozzle and to urge the piston slightly rearwardly away from the dispensing nozzle when the stem is retracted in order to release pressure on the piston and stop the flow of compound from the dispensing nozzle.

According to a preferred embodiment of the invention, the prong comprises an integral portion of the disk and is punched from and bent outwardly from the disk.

Preferably, the disk includes at least two prongs formed in spaced-apart relation on the disk for contacting the piston at two spaced-apart points.

Also preferably, the stem comprises a polygonal shape in cross-section and the gun also includes a latch dog carried on the cartridge holder adjacent the handle with the latch dog having a hole with a shape mated with the shape of the stem to receive the stem and prevent rotation of the stem.

According to another embodiment of the invention, the disk is releasably attached to the stem by means of a hole in the center of the disk mated to the shape of the stem to receive the stem and lock the stem and disk together against relative rotation with each other.

BRIEF DESCRIPTION OF THE DRAWINGS

Some of the objects of the invention have been set forth above. Other objects and advantages of the invention will appear as the description of the invention proceeds when taken in conjunction with the following drawings, in which.

DESCRIPTION OF THE PREFERRED EMBODIMENT

Figures 1, 4:
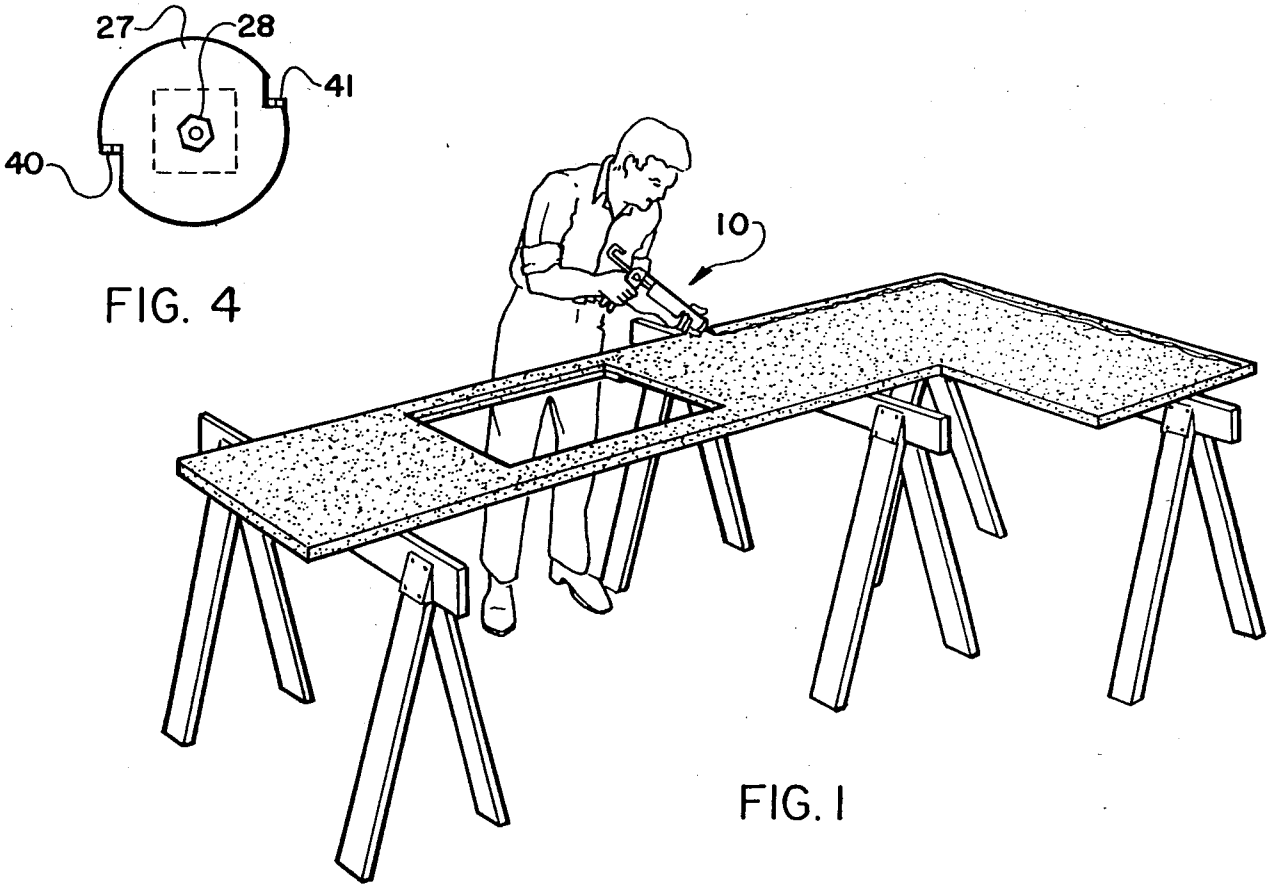
FIG. 1 is an environmental view showing a typical use of the caulking gun according to the present invention.
FIG. 4 is an end view of the disk showing the formation of the prongs therein.

Referring now specifically to the drawings, a caulking gun of the type described in this application is shown in FIG. 1 and generally indicated at 10. In the use shown, the caulking gun is being used to apply a bead of adhesive to the underside of a countertop. Other uses for such a caulking gun include applying insulating and waterproofing caulk to joints in walls and between windows and sashes.

Figure 2:
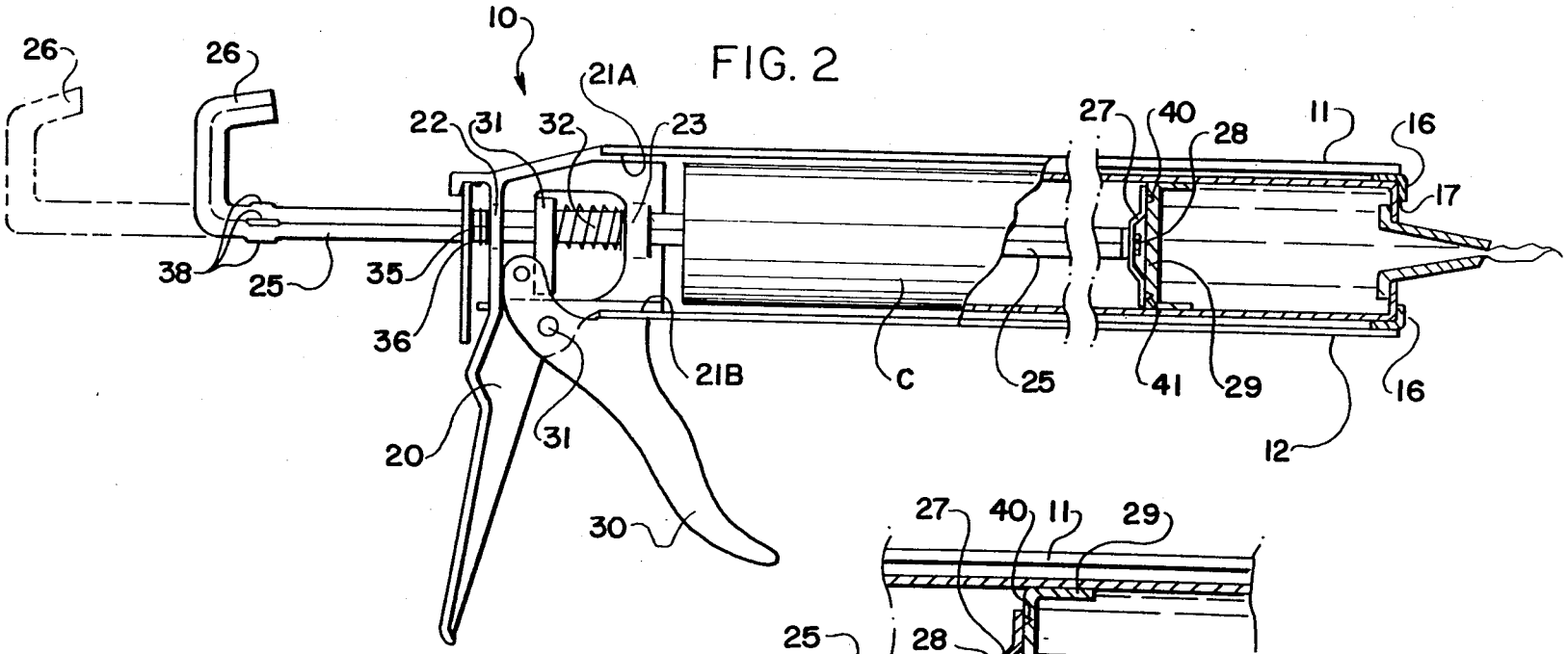
FIG. 2 is a side elevation, fragmentary cross-sectional view of a caulking gun according to the present invention.

Referring now to FIG. 2, caulking gun 10 is shown in more detail and comprises what is referred to as a "skeleton-type" gun. Gun 10 comprises upper and lower longitudinally extending frame members 11 and 12. Frame members 11 and 12 are held in suitably spaced-apart relation to receive a cartridge C filled with caulk, adhesive or some other compound. Frame members 11 and 12 are held in suitable spaced-apart relation on one end by means of an annular end cap 16 to which frame members 11 and 12 are suitably affixed by welding or otherwise. End cap 16 includes a centrally disposed opening 17 through which a dispensing nozzle D protrudes.

Frame members 11 and 12 are maintained in the appropriate spaced-apart relation on the other end by means of a handle 20. Handle 20 includes a frame 21 having recessed shoulders 21A and 21B to which frame members 11 and 12 are secured. Handle 20 also includes two spaced-apart annular support rings 22 and 23 through which is positioned an elongate stem 25. Stem 25 is bent into a U-shaped handle 26 which permits stem 25 to be retracted and also serves as a hook from which gun 10 may be hung for storage or on a ladder while in use. A disk 27 is affixed by means of a nut 28 to the other end of stem 25.

A trigger 30 is secured by means of a rivet 31 to handle 20. When handle 20 and trigger 30 are gripped in the hand and trigger 30 is pulled rearwardly toward handle 20, a stem actuator 31 moves forward against a return spring 32. Stem actuator 31 fits rather loosely on stem 25 and as stem actuator 31 is moved forward, it tilts slightly and bites into stem 25 sufficient to move it forward. Releasing trigger 30 causes return spring 32 to move stem actuator 31 rearwardly, thereby returning trigger 30 to its open position. Rearward movement of stem 25 with stem actuator 31 is prevented by a latch dog 35 positioned on stem 25 on the opposite side of support ring 22 from stem actuator 31. Latch dog 35 also fits rather loosely on stem 25 and permits stem 25 to move forward as trigger 30 is pulled toward handle 20. However, when trigger 30 is released, latch dog 35 bites into stem 25 and prevents it from moving rearwardly. To release stem 25 so that it can move rearwardly, the bottom end of latch dog 35 is depressed inwardly against the opposite force of a holdback spring 36. This movement creates an alignment between stem 25 and latch dog 35 sufficient to permit stem 25 to be moved rearwardly.

A series of notches 38 are formed into stem 25 adjacent handle 26. When these notches reach latch dog 35, stem 25 is prevented from moving any further forward. Notches 38 are positioned on stem 25 so that they reach latch dog 35 just as cartridge C empties. The disk 27 is therefore prevented from being moved further forward and possibly breaking off endcap 16 by pushing the cartridge C too far forward.

Still referring to FIG. 2, dispensing nozzle D comprises a tough, semi-flexible cone-shaped plastic structure formed into cartridge C which can be cut off with a knife at any point along its length to permit a bead of compound of a particular size to be expelled. As is shown in FIG. 2, the dispensing nozzle D is ordinarily cut in such a way as to define an angle having a particular articulation with reference to the cartridge C. By aligning the angle of the cut with, for example, a joint between two adjacent walls, the compound is forced into the joint and then smoothed as the upper, outwardly protruding end of discharge nozzle D contacts it. However, for this procedure to work correctly, the angle of the discharge nozzle D must remain constant. It has been observed, however, that as piston 29 is forced inwardly against the compound, many times it will slowly rotate due to irregularities in the shape of cartridge C or in the fit of piston 29 within cartridge C. Rotation of the cartridge C can also result from being held by the hand of the user, as is shown in FIG. 1. Since cartridge C is free to rotate within the space defined by frame members 11 and 12, cartridge C can be inadvertently rotated by the hand as the cartridge is gripped during use.

Figure 3:
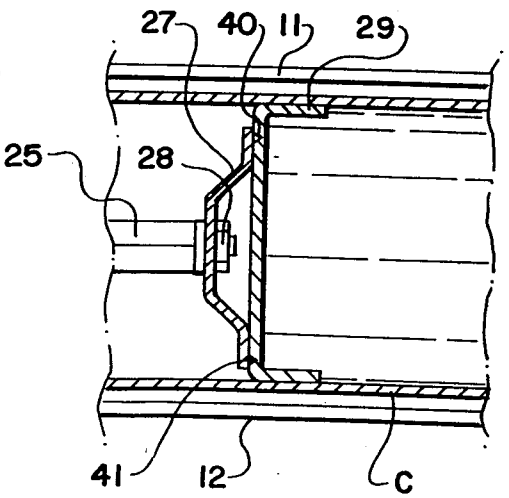
FIG. 3 is a fragmentary enlarged view of the disk and piston shown in FIG. 2.

Rotation of cartridge C can be greatly minimized or eliminated completely in accordance with the present invention shown more clearly in FIG. 3. A pair of forwardly extending prongs 40 and 41 penetrate the surface of but do not puncture piston 29. Since disk 27 is held on stem 25 against rotation, the prongs 40 and 41 prevent rotation of piston 29 within cartridge C. Therefore, prongs 40 and 41 not only prevent rotation of piston 29 within cartridge C but also greatly retard the rotation of cartridge C itself, since piston 29 tightly engages the walls of cartridge C.

Preferably, prongs 40 and 41 are integrally formed in disk 27 and are formed by cutting into disk 27 at an acute angle and then bending forward the point formed by the cut to define the prongs.

It has also been observed that the force with which the prongs engage piston 29 is sufficient so that, when pressure on disk 27 is released by engaging latch dog 35, the rearward movement of the prongs tends to exert a positive pull on piston 29 as well. This achieves a more positive release of pressure on the compound within cartridge C and prevents dripping or oozing of compound from discharge nozzle D after pressure is released.

A caulking gun is described above. Various details of the invention may be changed without departing from its scope. Furthermore, the foregoing description of the preferred embodiment of a caulking gun according to the present invention is provided for the purpose of illustration only and not for the purpose of limitation—the invention being defined by the claims.

We claim:

1. In a caulking gun of the type adapted to receive a tube-like cartridge of compound, wherein the cartridge has a piston in one end which expels compound from a dispensing nozzle as the piston is moved forward in the cartridge towards the dispensing nozzle, the gun having a cartridge holder, a handle attached to the cartridge holder, and trigger means cooperating with the handle to progressively urge a stem fixed against rotational movement relative to said cartridge holder and a disk fixed on the stem against rotational movement relative to the stem against the piston of the cartridge to expel compound from the discharge nozzle, the improvement which comprises at least one outwardly projecting prong eccentrically positioned on the disk in contact relation with the piston of the cartridge for wedging into the contact surface of the piston in non-undercutting relation to the piston without puncturing through the piston into the cartridge whereby compound is prevented from leaking therefrom, said prong engaging said piston to prevent clockwise or counterclockwise rotation of the cartridge as compound is expelled in order to maintain the angle of articulation of an angularly-cut dispensing nozzle and to exert a positive pull on the piston to urge it slightly rearwardly away from the dispensing nozzle as the stem is retracted from contact with the piston and before disengaging completely from the piston in order to release pressure on the piston and stop the flow of compound from the dispensing nozzle.

2. In a caulking gun according to claim 1, wherein said prong comprises an integral portion of said disk punched from and bent outwardly from the disk.

3. In a caulking gun according to claim 1 or 2, wherein the disk includes at least two prongs formed in spaced-apart relation on the disk for contacting the piston at two spaced-apart points.

4. In a caulking gun according to claim 3, wherein said stem comprises a polygonal shape in cross-section, and wherein said gun includes a latch dog carried on the cartridge holder adjacent the handle, the latch dog having a hole with a shape mated with the shape of the stem to receive the stem and prevent rotation thereof.

5. In a caulking gun according to claim 1, wherein the disk is releasably attached to the stem.

* * * * *